US007052319B1

(12) United States Patent
Chen

(10) Patent No.: US 7,052,319 B1
(45) Date of Patent: May 30, 2006

(54) CONNECTOR

(75) Inventor: Hsiang Feng Chen, Yungkang (TW)

(73) Assignee: Aimmet Ibdustrial Co., Ltd., Tainan (TW)

( * ) Notice: Subject to any disclaimer, the term of this patent is extended or adjusted under 35 U.S.C. 154(b) by 0 days.

(21) Appl. No.: 11/126,601

(22) Filed: May 10, 2005

(51) Int. Cl.
*H01R 13/40* (2006.01)

(52) U.S. Cl. ..... 439/595; 439/680

(58) Field of Classification Search ..... 439/595, 439/680, 350, 744
See application file for complete search history.

(56) References Cited

U.S. PATENT DOCUMENTS 6,247,965 B1 * 6/2001 Cummings et al. ..... 439/587
6,386,888 B1 * 5/2002 Skopic et al. ..... 439/63
6,824,403 B1 * 11/2004 Hall et al. ..... 439/108
2004/0157498 A1 * 8/2004 Hall et al. ..... 439/680

FOREIGN PATENT DOCUMENTS

| | | |
|---|---|---|
| TW | 00076022 | 3/1986 |
| TW | 505590 | 5/1989 |
| TW | 559391 | 1/1992 |

* cited by examiner

*Primary Examiner*—Briggitte Hammond
*Assistant Examiner*—X. Chung-Trans

(57) ABSTRACT

A connector includes a body and a terminal. The body has an interior hollow for the terminal to fit therein and an outer surface provided with plural axial projecting ridges. The interior hollow has a large diameter portion, a medium diameter portion and a small diameter portion. The terminal is made of a metal, having an insulating tubular member, a large annular wall in an intermediate portion and a small annular wall behind the large annular wall, and the large annular wall fits in the medium diameter portion of the interior hollow of the body, and the small annular wall fits in the small diameter portion. So the terminal may be combined with the body stably.

1 Claim, 4 Drawing Sheets

CONNECTOR

BACKGROUND OF THE INVENTION

1. Field of the Invention

This invention relates to a connector, particularly to one easy to connect conductive wires of a power vehicle.

2. Description of the Prior Art

A cable connector disclosed in a Taiwan patent No. 559391 includes an insulating shell provided with a first connect end and a second connect end, an interior hollow formed between the first and the second connect end. Further, plural conductive terminals are fitted in the interior hollow, having a contact member and a connecting member to connect with a power wire. A light emitter is fixed at one side of the insulating shell, connected with the power wire.

"Waterproof electric connector" disclosed in Taiwan patent No. 505590 includes a sealing member, a housing, a cap closing on the housing, a hollow chamber formed between the housing and the cap, a flat band cable fitted in the hollow chamber, and a circuit board positioned between the housing and the cap. The sealing member is located between the circuit board and the cap or the housing.

Next, "Waterproof plug and socket connector" disclosed in a Taiwan patent No. 76022 includes a pivotal plug and a pivotal socked, a rubber gasket respectively fitted around a contact terminal, a front end and a rear end, and a cylinder screwed with the pivotal plug and the pivotal socket for tightening the rubber gaskets to attain sealing effectiveness and securing pivotal function.

However, the three conventional connectors are constituted with more than two components, having a rather complicated structure, resulting in a high cost. They are not so outstanding in the quality and effectiveness to be used for a power vehicle.

SUMAMRY OF THE INVENTION

The feature of the invention is a body having an interior hollow and a terminal combined in the interior hollow of the body stably. The interior hollow has a large diameter portion, a small diameter portion behind the large diameter portion and a medium diameter portion behind the small diameter portion at a front end of the body. The terminal has a large annular projection in an intermediate portion to fit with the medium diameter portion of the interior hollow of the body, and a small annular projecting to fit with the small diameter portion of the interior hollow, so the terminal can be fitted in the body very stably.

BRIEF DESCRIPTION OF DRAWINGS

This inventin will be better understood by referring to the accompanying drawings, wherein.

DETAILED DESCRIPTION OF THE PREFERRED EMBODIMENT

Figure 1:
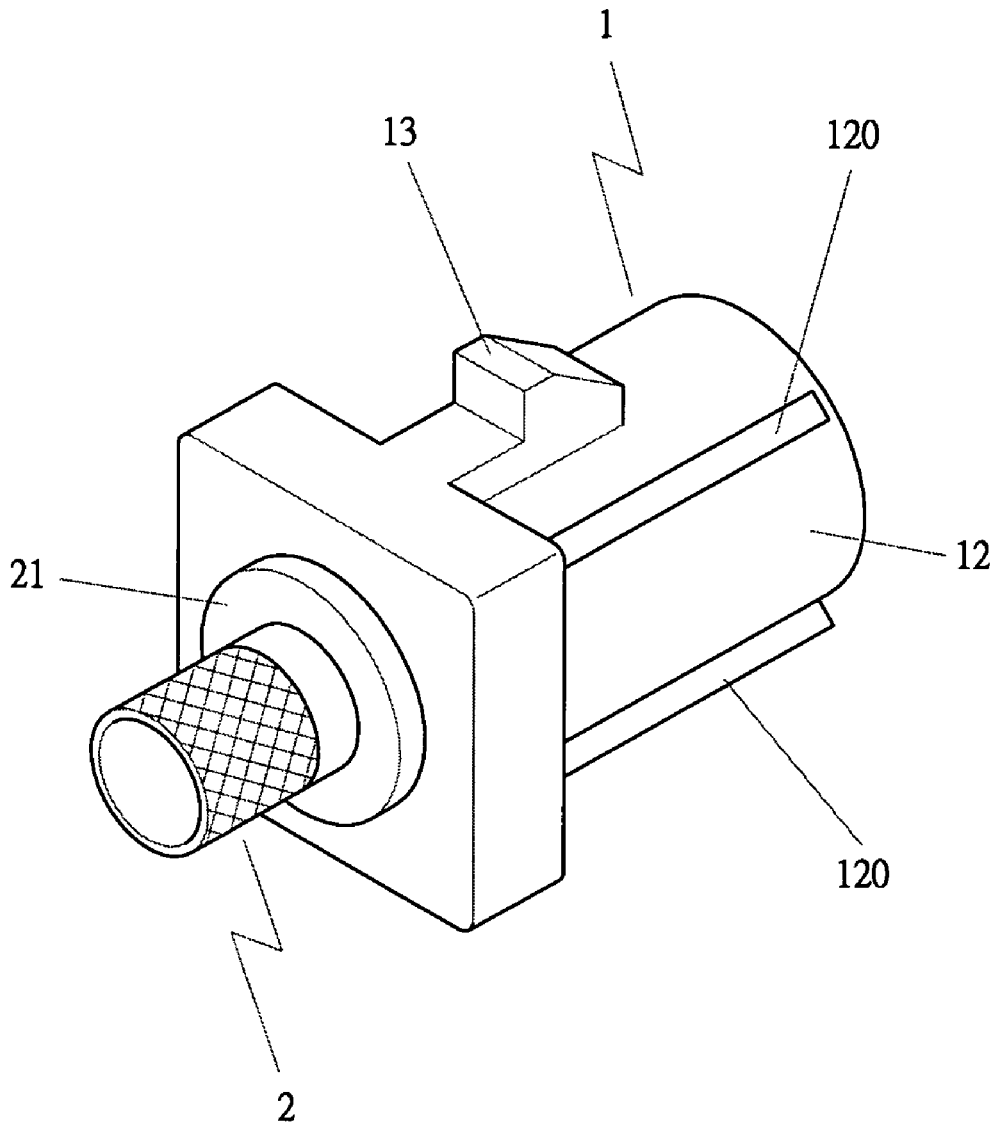
FIG. 1 is a perspective view of a connector in the present invention.
Figure 2:
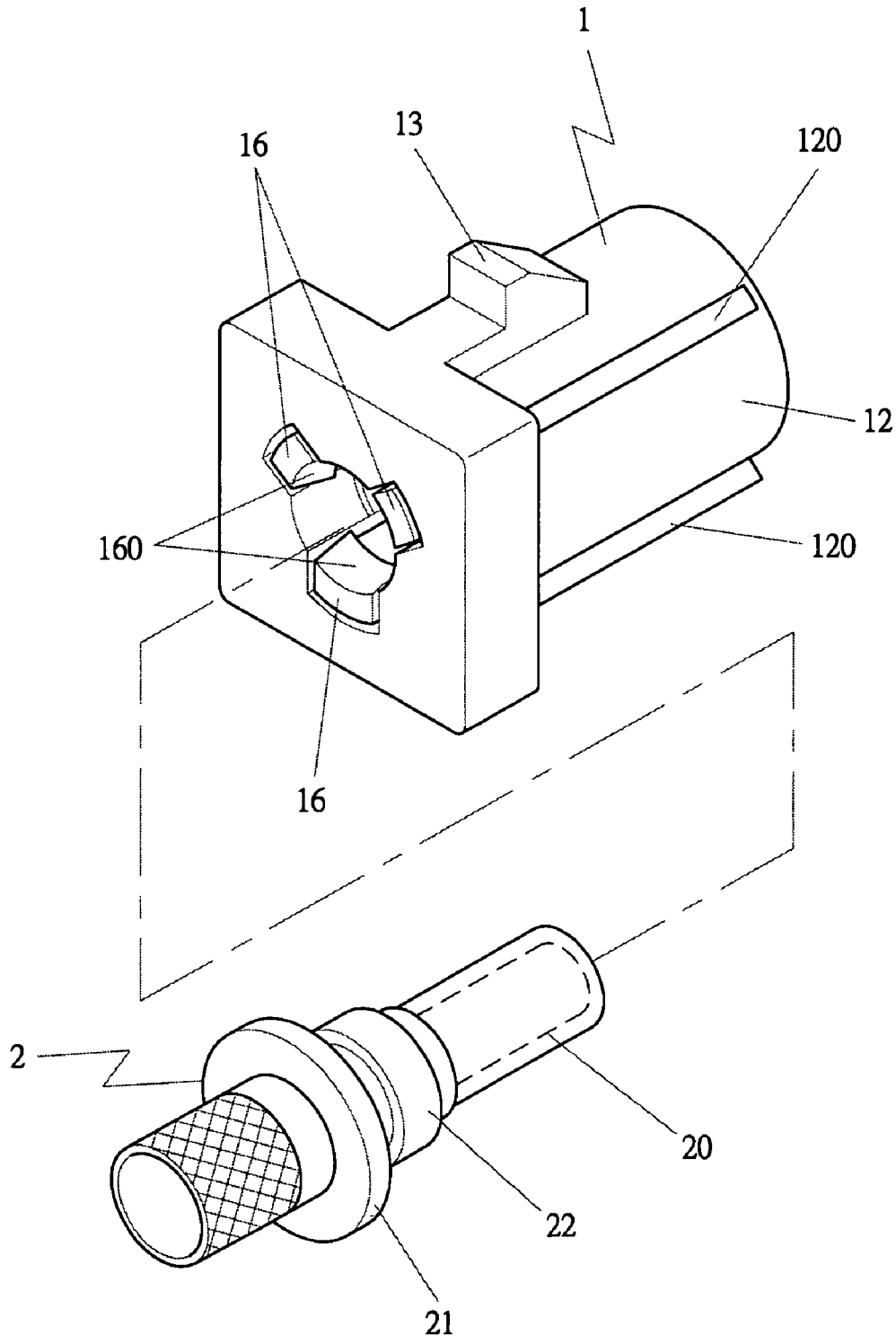
FIG. 2 is an exploded perspective view of the connector in the present invention.
Figure 3:
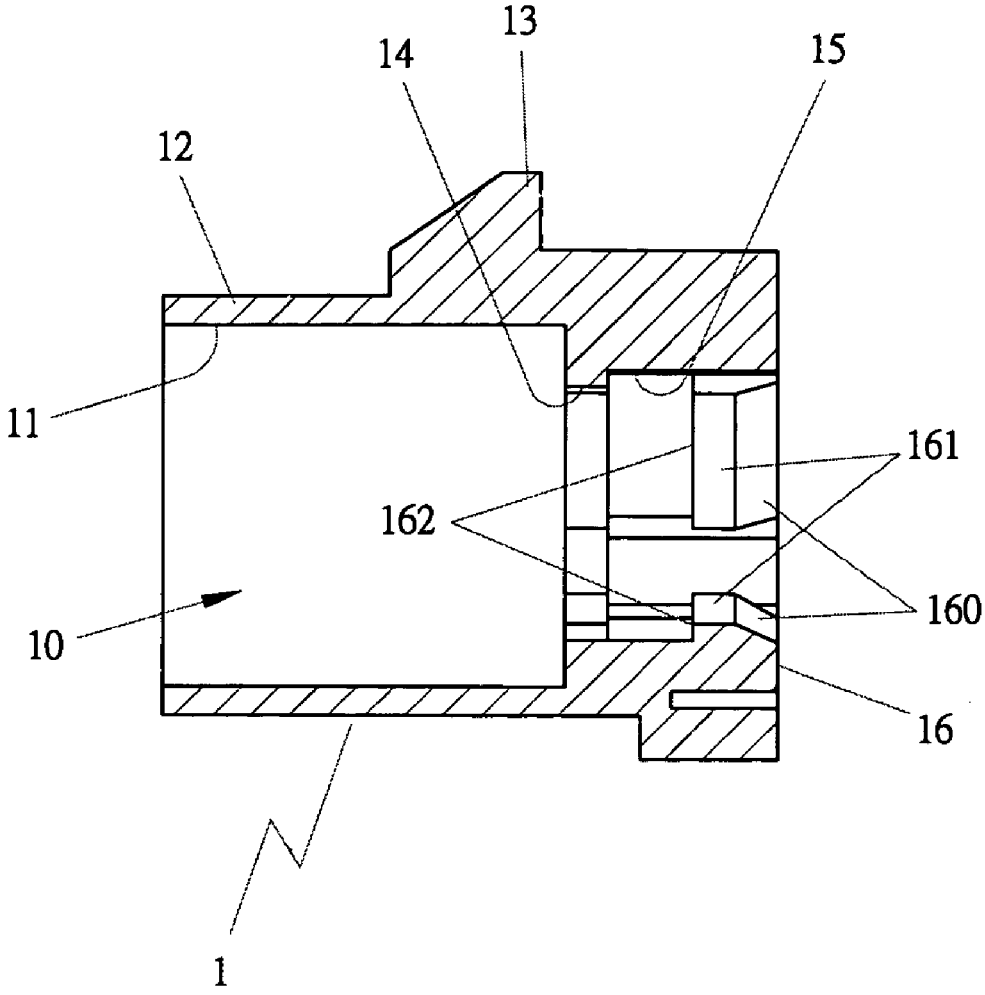
FIG. 3 is a cross-sectional view of the connector in the present invention.
Figure 4:
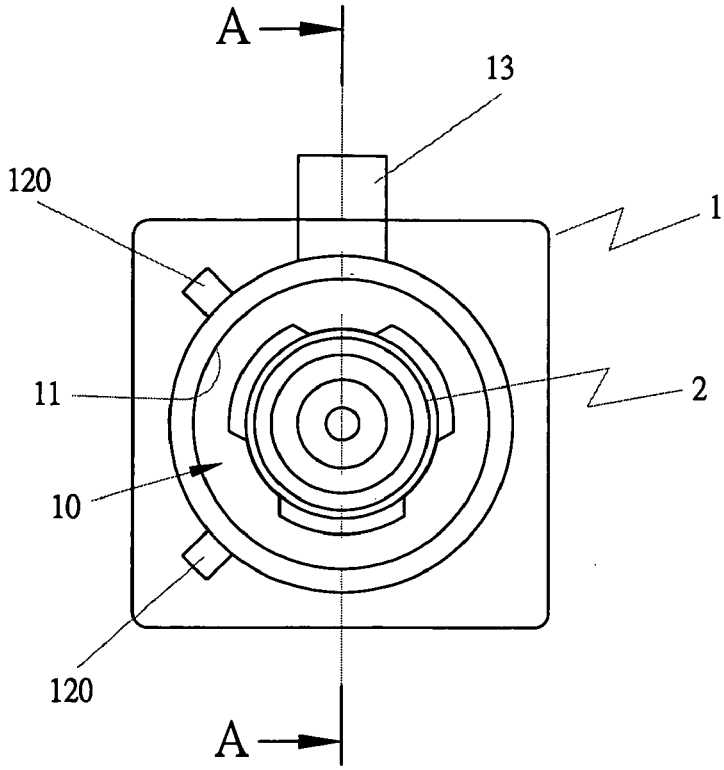
FIG. 4 is a rear view of the connector in the present invention.
Figure 5:
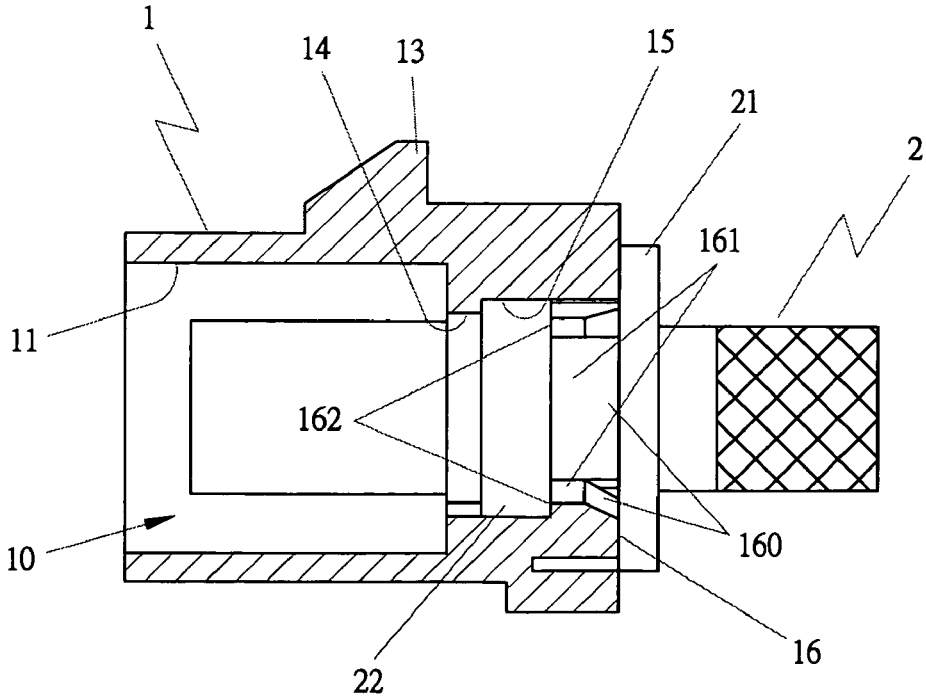
FIG. 5 is a cross-sectional view of the line A—A in FIG. 4.

A preferred embodiment of a connector in the present invention, as shown in FIG. 1, includes a body 1, and a terminal 2 as main components.

The body 1 is provided with an interior hollow 10, a large diameter portion 11 formed in the interior hollow 10 for the terminal 2 to fit therein, and an outer circumference 12, a plural projecting ridges 120 axially formed spaced apart on the outer circumference 12 for the male/female connector to mutually fit together for adjusting to keep the polarity correct after connection. Further, the outer circumference 12 has a tenon 13 formed integral for tight connection with a male/female connector after connected together. The interior hollow 10 further has a small diameter portion 14 behind the large diameter portion 11 and a medium diameter portion 15 to correspond to related members of the terminal 2. The medium diameter portion 15 has plural elastic petals 16 spaced apart equidistantly around, and each elastic petal 16 has a sloped surface 160, a circumferential surface 161 and a vertical contact surface 162. The sloped surface 160 is beneficial for the terminal 2 to quickly move in the body, and, the vertical surface 162 for securing the terminal 2 stably not to slide out so the terminal 2 may be combined with the body 1 in a stably positioned condition.

The terminal 2 is made of a metal, having an insulating tubular member 20 made of Teflon fitted in an inner side, a large annular wall 21 in an intermediate portion and a small annular wall 22 behind the large annular wall 21 to respectively match with the medium annular surface 15 and the small annular surface 14 of the interior hollow of the body 1 so as to let the terminal 2 combined with the body 1 stably.

In this way, the connector only has two components, the body 1 and the terminal 2 quickly and stably combined together, enhanced in the quality better than that of the conventional ones.

While the preferred embodiment of the invention has been described above, it will be recognized and understood that various modifications may be made therein and the appended claims are intended to cover all such modifications that may fall within the spirit and scope of the invention.

What is claimed is:

1. A connector comprising:

a body formed integral and having an interior annular hollow, said interior hollow having a large diameter portion, a plurality of axial projecting ridges formed on an outer annular surface of said body for adjusting the location of a male/female connector in connecting with said connector, said interior hollow having a small diameter portion behind said large diameter portion and a medium inner diameter portion behind said small inner diameter portion, said medium diameter portion located at a front end of said body, a plurality of elastic petals fitted spaced apart around said medium inner portion, each said elastic petal having a sloped curved surface, a circumferential surface and a vertical contact surface;

a terminal of tubular shape made of metal and having an insulating tubular member fixed in an inside, a large diameter annular projection formed in an intermediate portion of said terminal, a small diameter annular projection formed behind said large diameter annular projection, said large diameter annular projection fitting with said medium diameter portion of said interior hollow of said body, said small diameter annular portion fitting with said small inner diameter portion of said interior hollow of said body, said terminal thus possible to be combined with said body stably.

* * * * *